United States Patent [19]

Peters

[11] Patent Number: 5,014,937

[45] Date of Patent: May 14, 1991

[54] RAILWAY SWITCH STAND AND METHOD OF MODIFYING THE SAME

[76] Inventor: Terry D. Peters, Rte. 4, Box 19, Elkhorn, Nebr. 68022

[21] Appl. No.: 392,060

[22] Filed: Aug. 10, 1989

[51] Int. Cl.[5] ..... B61L 5/02

[52] U.S. Cl. ..... 246/406; 246/489

[58] Field of Search ..... 246/393, 401, 402, 406, 246/407, 489

[56] References Cited

U.S. PATENT DOCUMENTS

| | | | |
|---|---|---|---|
| 381,773 | 4/1888 | Gibbs | 246/145 |
| 391,168 | 10/1988 | Mansfield | 246/284 |
| 485,868 | 11/1892 | Hill | 246/393 |
| 488,182 | 12/1892 | Christiansen | 246/406 |
| 707,010 | 8/1902 | Remington | 246/406 |
| 768,060 | 8/1904 | Mansfield | 246/409 |
| 1,127,959 | 2/1915 | Burns | 246/406 |
| 1,814,307 | 7/1931 | Gray | 246/289 |
| 2,510,815 | 6/1950 | Granche | 246/393 |
| 3,652,849 | 3/1972 | Kleppick | 246/393 |
| 4,824,054 | 4/1989 | Kohake et al. | 246/406 |
| 4,938,438 | 7/1990 | Farrell et al. | 246/406 |

*Primary Examiner*—Robert J. Spar
*Assistant Examiner*—Scott L. Lowe
*Attorney, Agent, or Firm*—Zarley, McKee, Thomte, Voorhees & Sease

[57] ABSTRACT

A method for modifying a railway switch stand is utilized on conventional switch stands having a table mounted on legs above a base plate, a rotatable throw crank having a shaft extending vertically from the base plate through the table, and a handle extending from a yoke which is attached to the throw crank shaft above the table. The first step in modifying the switch stand is to remove the handle and yoke from the throw crank shaft. A housing having gear works therein is mounted to the table and a yoke within the housing is attached to the throw crank shaft. A bevel gear in the gear works is mounted on the yoke for rotation with the shaft, and a pinion gear is mounted in the housing for rotation intermeshed with the first bevel gear. A rotatable wheel-type handle is mounted to the pinion gear so as to enable the switch to be open or throw by rotating the handle and thereby rotating the throw crank shaft. The gears are designed to provide a gear reduction of about four to one so that one full rotation of the wheel will rotate the throw crank shaft approximately 90°. A pivotable arm is provided on the wheel which will engage the lot of a backing plate mounted adjacent the wheel, so as to selectively lock the wheel in a specific position. The method includes the additional step of removing the switch stand table. In this method, the adaptor has the housing and gear works mounted directly on a switch stand table. The replacement table with the adaptor is then mounted on the switch stand legs with bolts, and the adaptor yoke sleeve is connected to the throw crank shaft.

9 Claims, 5 Drawing Sheets

RAILWAY SWITCH STAND AND METHOD OF MODIFYING THE SAME

TECHNICAL FIELD

The present invention relates generally to railway switch stands, and more particularly to an adapter kit and method for modifying a switch stand to increase the mechanical advantage in operating the switch.

BACKGROUND OF THE INVENTION

Railway switch stands have been utilized on railroads for many years, and are the subject of a large number of patents. However, the current switch stands in operation still suffer several drawbacks. The major problem with present day hand-operated throw-type switches is in the many back and leg injuries to railroad personnel caused by the actual throwing of the switch. Such injuries can be quite expensive to the railroad in loss of personnel and damage suits brought by the injured persons. Although electric and other types of switches have been utilized in some areas, typically such switches are expensive and are not practical in all types of operations.

Another problem with current switch stands, as well as with prior art inventions, is in the requirement that the entire switch stand be replaced with new or modified versions so as to gain some slight advantage. It would be prohibitively expensive to replace all existing hand-thrown switch stands with electric or modified stands, as well as requiring vast man-hours in the actual transition.

It is therefore a general object of the present invention to provide an adaptor kit for existing switch stands which will increase the mechanical advantage of the switch stand.

Another general object is to provide a method for modifying a conventional switch stand to increase its mechanical advantage.

A further object is to provide a method for modifying a switch stand which is simple to accomplish and requires the removal of only a few parts from the switch stand.

Another object of the present invention is to provide an improved switch stand which requires less effort to throw the switch A further object of the present invention is to provide an adaptor for modifying an existing switch stand which is economical to manufacture and simple to use.

These and other objects of the present invention will be apparent to those skilled in the art.

SUMMARY OF THE INVENTION

The method for modifying a railway switch stand of the present invention is utilized on conventional switch stands having a table mounted on legs above a base plate, a rotatable throw crank having a shaft extending vertically from the base plate through the table, and a handle extending from a yoke which is attached to the throw crank shaft above the table. The first step in modifying the switch stand is to remove the handle and yoke from the throw crank shaft. A housing having gear works therein is mounted to the table and a yoke within the housing is attached to the throw crank shaft. A bevel gear in the gear works is mounted on the yoke for rotation with the shaft, and a pinion gear is mounted in the housing for rotation intermeshed with the first bevel gear. A rotatable wheel-type handle is mounted to the pinion gear so as to enable the switch to be open or throw by rotating the handle and thereby rotating the throw crank shaft. The gears are designed to provide a gear reduction of about four to one so that one full rotation of the wheel will rotate the throw crank shaft approximately 90°. A pivotable arm is provided on the wheel which will engage the slot of a backing plate mounted adjacent the wheel, so as to selectively lock the wheel in a specific position.

In some cases, the conventional switch stand table is replaced during the modification of the switch stand. This is a convenient method of modifying the switch stand during normal reconditioning of a switch stand. In such a case, the rivets which normally hold the table on the switch stand legs are removed, and a table having a housing with gear works thereon is mounted to the switch stand legs using bolts or the like.

DESCRIPTION OF THE PREFERRED EMBODIMENT

Figure 2:
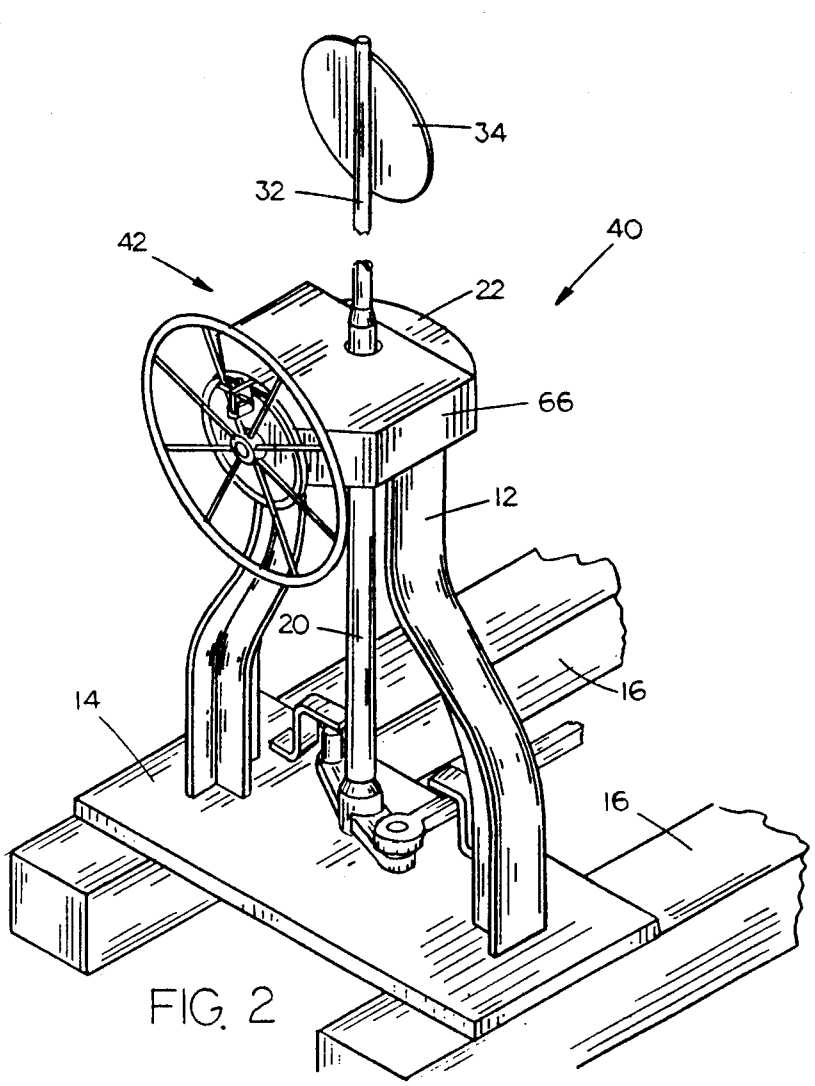
FIG. 2 is a perspective view of the switch stand of the present invention.
Figure 1:
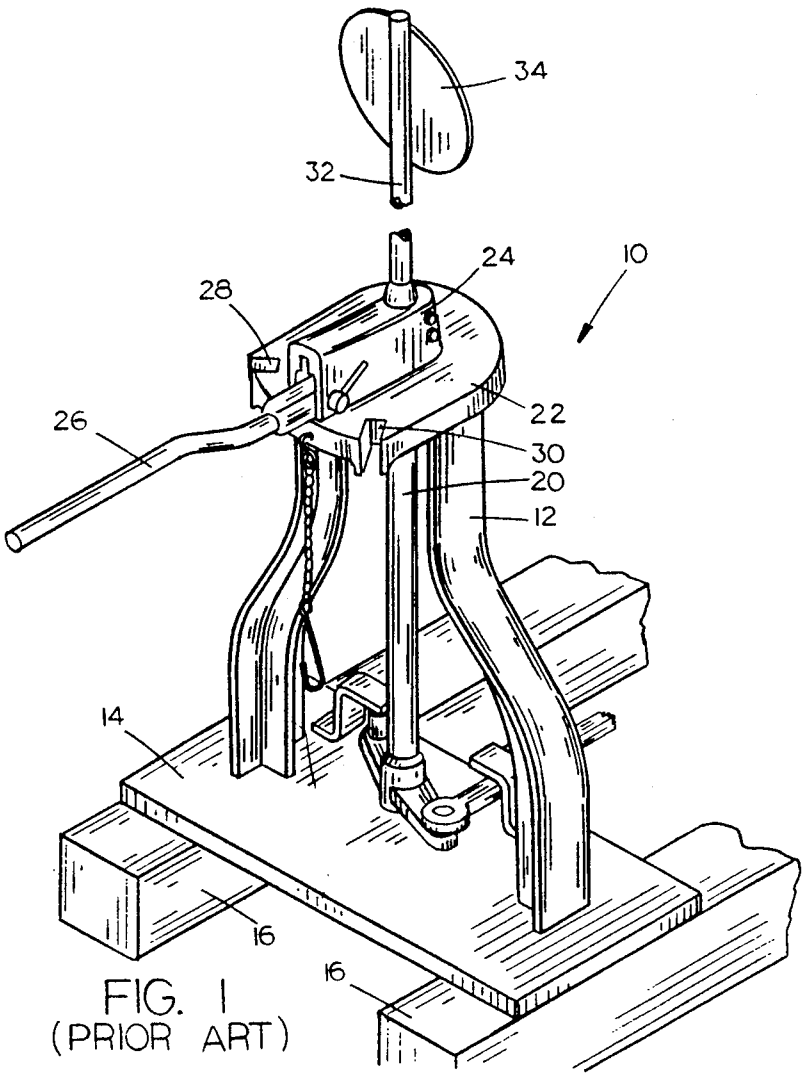
FIG. 1 (PRIOR ART)
FIG. 1 is a perspective view of a prior art switch stand.
Figure 4:
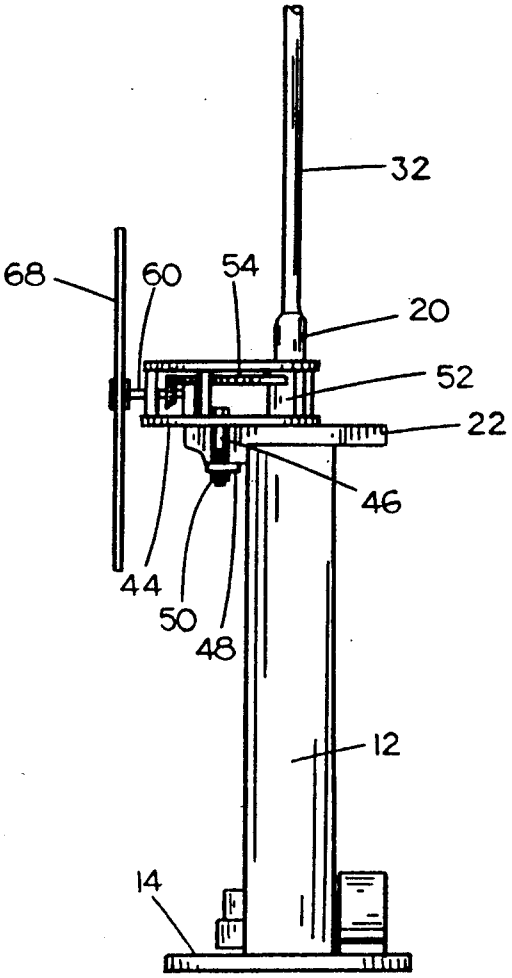
FIG. 4 is a side elevational view of the switch stand of the present invention with the adaptor housing removed.
Figure 3:
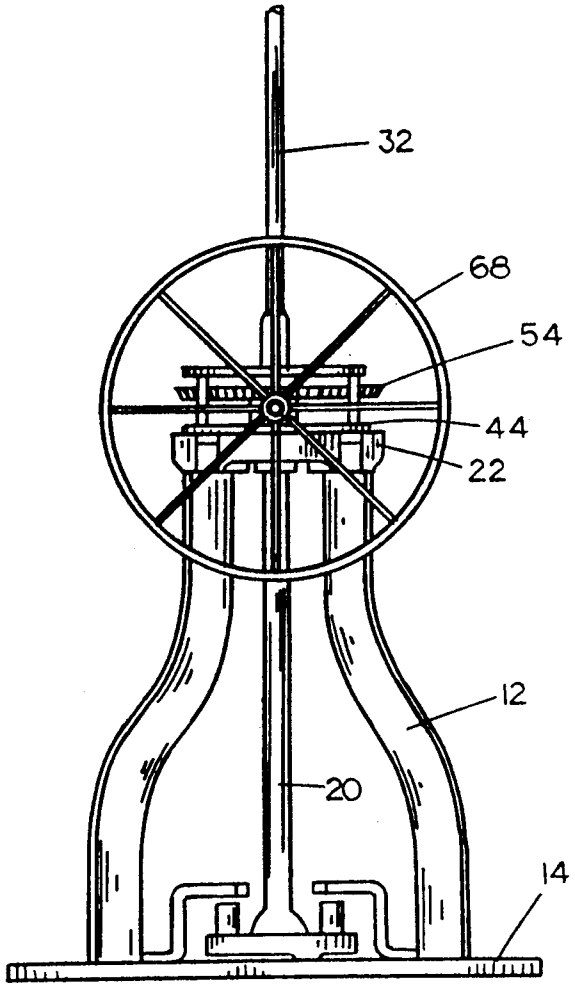
FIG. 3 is a front elevational view of the switch stand of the present invention with the housing on the adaptor structure removed.
Figure 5:
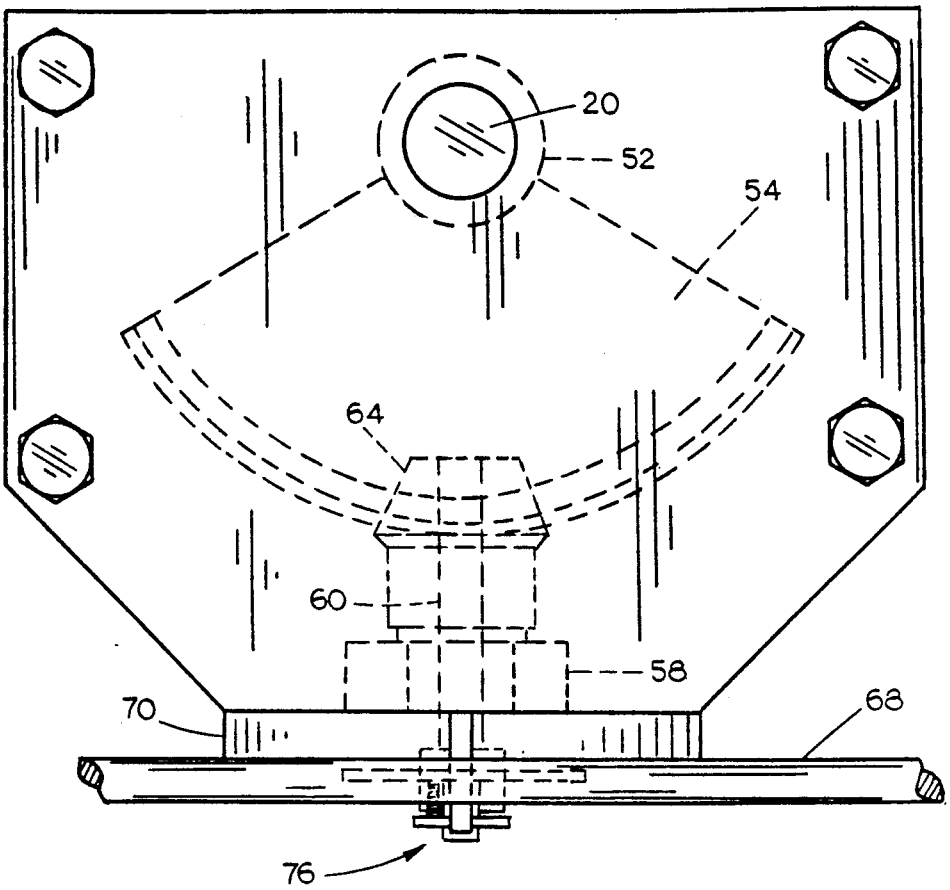
FIG. 5 is an enlarged top elevational view of the adaptor portion of the invention.
Figure 6:
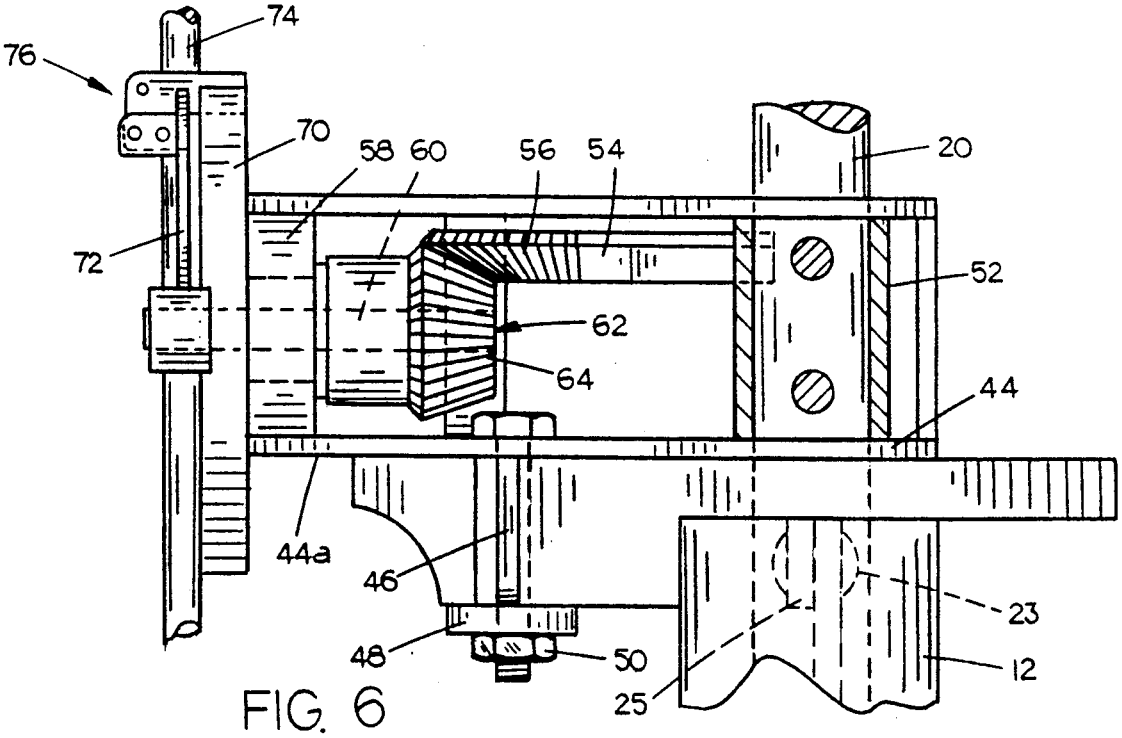
FIG. 6 is an enlarged side elevational view of the adaptor portion of the invention.

Referring now to the drawings, in which identical or corresponding parts are identified with the same reference numeral, and more particularly to FIG. 1, a conventional switch stand is indicated generally at 10. Switch stand 10 includes a pair of steel legs 12 projecting upwardly from a base plate 14 mounted between a pair of parallel ties 16. A pivot pin 18 (not shown) projects upwardly from base plate 14 between legs 12 which will receive the lower end of a hollow tubular throw crank 20 oriented generally vertically between legs 12. A horizontally oriented table 22 is mounted between the upper ends of legs 12 via a rivet 23 journaled through a dog ear 25 and each leg 12 (see FIG. 6). Table 22 has an aperture centered therein through which throw crank 20 is journaled. The upper end of throw crank 20 projects upwardly beyond table 22 and has a collar-like yoke 24 affixed thereto for rotation therewith. Yoke 24 has a handle 26 pivotally connected thereto which may be pivoted to a horizontal orientation to rotate throw crank 20 on pivot pin 18. Handle 26 may be pivoted to a vertical orientation so as to journal handle 26 within one or the other of two vertically oriented slots 28 and 30 formed in the edge of table 22, as shown in the drawings. Insertion of handle 26 within slot 28 or slot 30 prevents rotation of throw crank 20. A target rod 32 is fastened to the upper end of throw crank 20 and extends upwardly vertically therefrom to support one or more targets 34 which convey information to a train passing along the corresponding track.

Referring now to FIGS. 2–6, the modified switch stand of the present invention is designated generally at 40 and includes an adaptor 42 which replaces the yoke and yoke handle 24 and 26 of the conventional switch stand 10 shown in FIG. 1. All of the remaining elements of the switch stand 40 are identical to those of conventional switch stand 10, and are given identical reference numerals. Adaptor 42 includes a base plate 44 mounted atop table 22 utilizing a pair of bolts 46 which extend through apertures in base plate 44 and into table slots 28 and 30. A clamp plate 48 extends between the lower projecting ends of bolts 46 and acts as a clamp when nuts 50 are threaded on the lower end of bolts 46.

A yoke sleeve 52 is mounted on the upper end of throw crank 20 and is affixed thereto for rotation therewith. A partial gear 54 is mounted on sleeve 52 and projects horizontally therefrom. Partial gear 54 is a partial section of a circle, preferably approximately 120°, with the teeth 56 projecting radially from the circumferential edge (see FIGS. 5–6). Partial gear 54 is a portion of a beveled gear, with teeth 56 set at a beveled angle.

A bushing 58 is mounted on base plate 44 at the forward end 44*a* thereof, with its longitudinal axis perpendicular to the longitudinal axis of throw crank 20. Bushing 58 rotatably supports a horizontally oriented shaft 60 which has a pinion 62 affixed on one end thereof having teeth 64 beveled to intermesh with the teeth of partial gear 54. The number of teeth and sizes of pinion 62 and partial gear 54 are designed to effect an approximately four to one mechanical advantage. A housing 66 (see FIG. 2) encloses the mechanism so as to prevent fouling of the gears and injuries to users.

Figure 8:
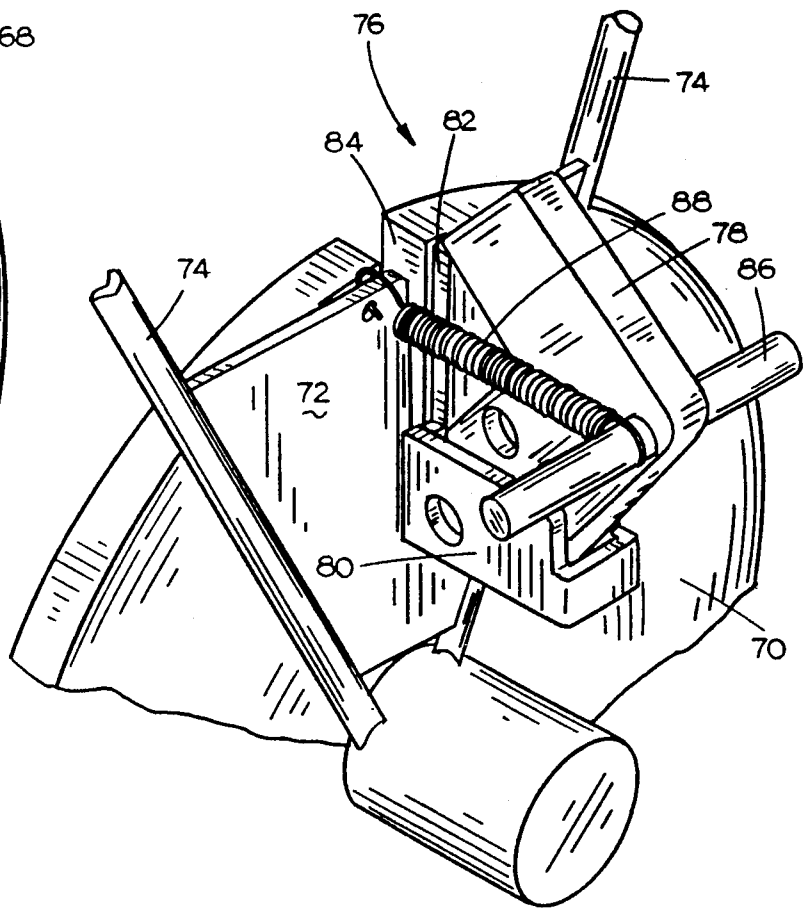
FIG. 8 is an enlarged perspective view of the handle locking mechanism.
Figure 7:
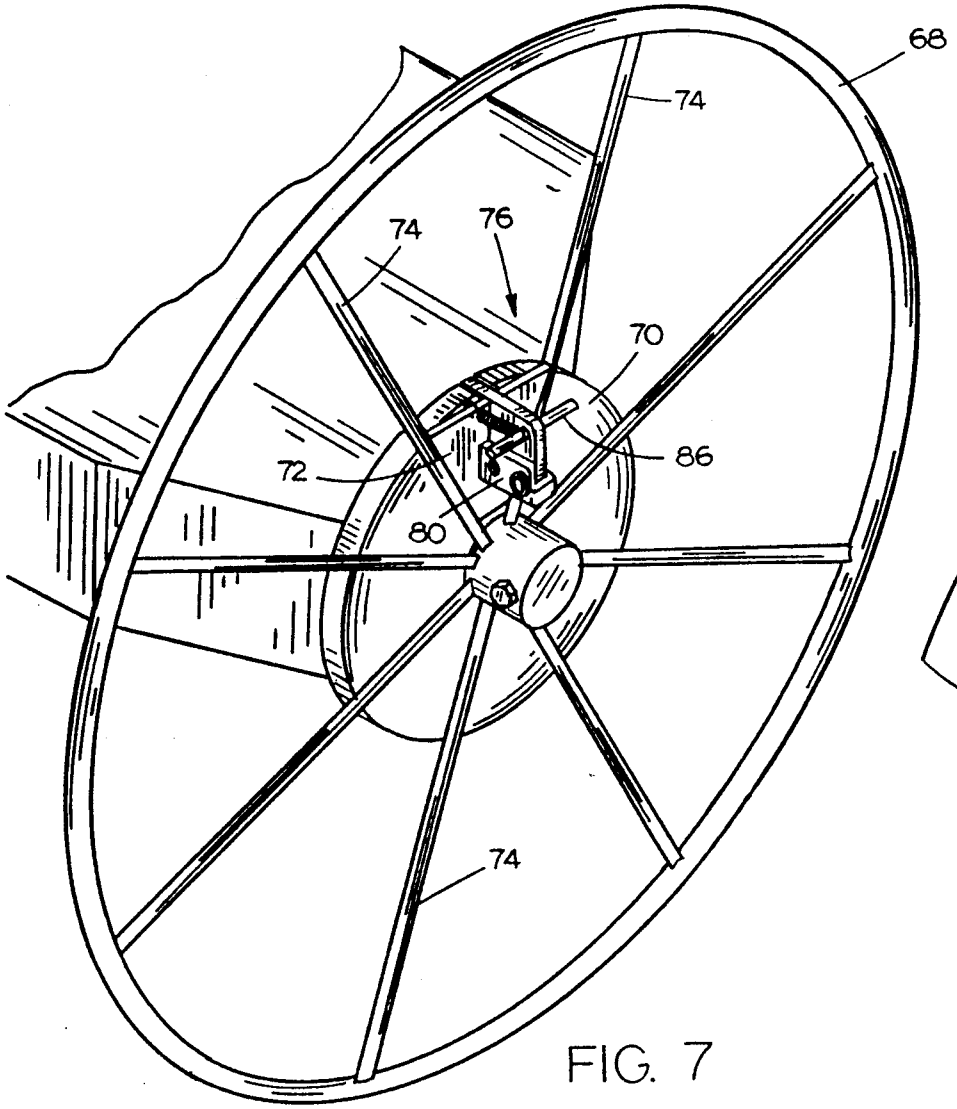
FIG. 7 is a perspective view of the handle locking mechanism.

A wheel-type handle 68 is mounted on the projecting end of shaft 60 and may be rotated so as to rotate throw crank 20. A circular flat backing plate 70 is mounted on bushing 58 between wheel 68 and bushing 58, parallel to wheel 68. A wedge shaped plate 72 is affixed between a pair of spokes 74 on wheel 68, and is parallel to backing plate 70. A locking mechanism 76 is pivotally mounted on wedge plate 72 to selectively lock wheel 68 in nonrotatable position, as shown in FIGS. 7–8. Locking mechanism 76 includes an arm 78 pivotally mounted between the ears of a U-shaped bracket 80 affixed to wedge plate 72. Arm 78 is pivotable into a generally horizontally oriented position extending into a slot 82 in wedge plate 72 and also into a slot 84 in backing plate 70. Arm 78 thereby prevents rotation of wheel 68. A handle 86 projecting from arm 78 allows manual pivoting of the arm from the horizontal locked position to a vertically oriented unlocked position. A spring 88 may be mounted between handle 86 and wedge plate 72 so as to bias arm 78 into the locked position. Arm 78 may be secured in the locked position utilizing a padlock extending through apertures in U-bracket 80 and through an aperture in arm 78.

In order to convert a conventional switch stand 10 into a modified switch stand 40, the initial step is to remove yoke 24 and yoke handle 26 from the conventional switch stand. Yoke sleeve 52 may then be received on throw crank 20 and adaptor base plate 44 may be bolted in position on table 22. Yoke sleeve 52 may be secured to throw crank 20 in any conventional manner, such as by bolts, rivets, etc. Housing 66 may then be secured to adaptor 42 so protect the interior works. After this simple conversion, the user may easily rotate throw crank 20 so as to throw a railway switch merely by rotating wheel 68 in the appropriate direction.

Figure 9:
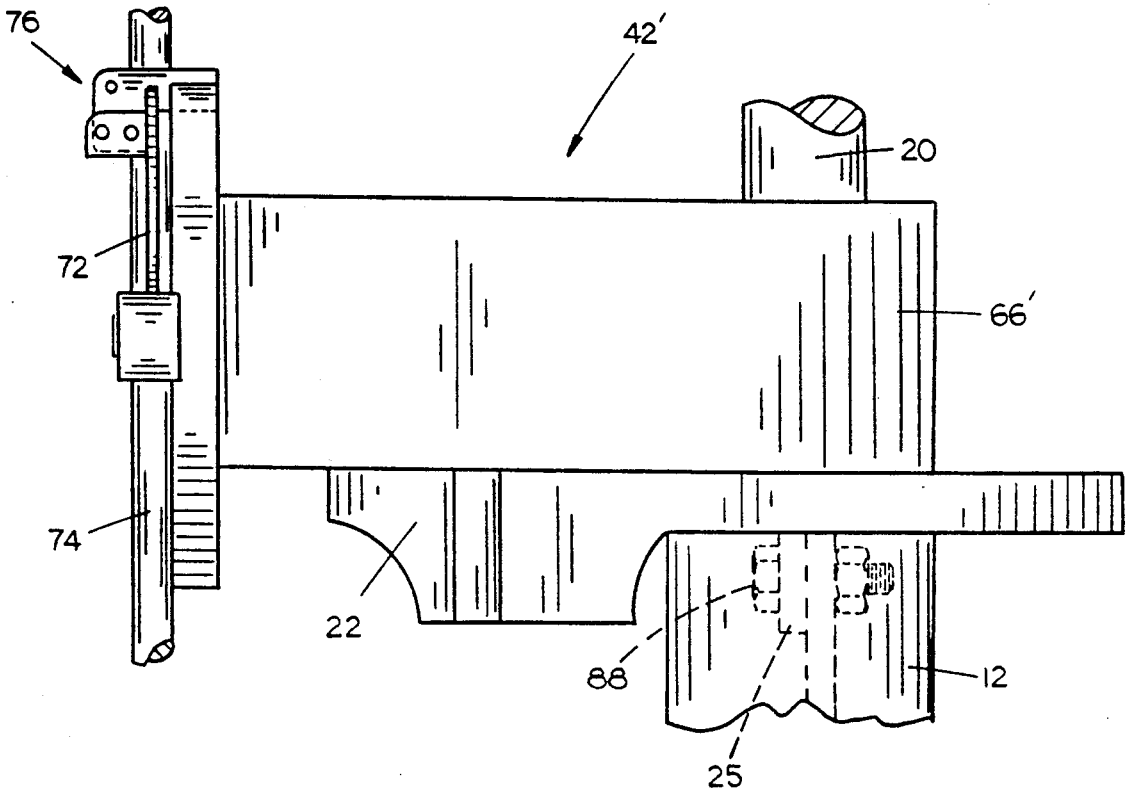
FIG. 9 is an enlarged side elevational view of a second embodiment of the adaptor portion of the invention.

Referring now to FIG. 9, a second embodiment of the invention is designated generally at 42' and includes an identical gear works within a housing 66', as described hereinabove. Adaptor 42' is designed for use on those occasions where table 22 must be removed from legs 12 for reconditioning or the like. Table 22 is removed by cutting rivets 23 journaled through dog ears 25 depending from table 22, and fastening the table to legs 12 (see FIG. 6). Housing 66' may be directly mounted to table 22 by welding or the like, thereby avoiding the necessity of the bolt and clamp plate assembly 46, 48 of the previous embodiment (shown in FIG. 6). Thus, the initial step in converting a conventional switch stand to a modified switch stand is to remove the original table 22 with its yoke and yoke handle. An adaptor 42' already has housing 66' mounted on a table 22, and may be directly journaled onto throw crank shaft 20 until table 22 rests on legs 12. A nut and bolt combination 88 is then fastened through each dog ear 25 depending from table 22 and through an aperture in legs 12 to fasten table 22 to legs 12.

Whereas the invention has been shown and described in connection with the preferred embodiment thereof, it will be understood that many modifications, substitutions and additions may be made which are within the intended broad scope of the appended claims. Thus, there has been shown and described a railway switch stand which accomplishes at least all of the above-stated objects.

I claim:

1. A method for modifying a conventional switch stand, said switch stand of the type having a reciprocating connecting rod extending therefrom for operating a railway track switch to open and thrown positions, a throw crank operably mounted on a base and connected to the connecting rod to reciprocate the connecting rod, said throw crank including a vertically oriented shaft extending upwardly from the base and rotatable to reciprocate the connecting rod, a table mounted on legs and supported above the base, said throw crank being journaled through an aperture in said table and projecting upwardly therefrom, an operable throw crank rotating apparatus connected to the throw crank shaft above the table for rotation with said shaft, and a handle connected to said throw crank rotating apparatus for operating said apparatus to rotate said shaft, comprising the steps of:

removing said handle and throw crank rotating apparatus from said throw crank shaft;

providing an adaptor comprising:

gear works operably mounted within a housing;

said housing having means for removably mounting said housing on the switch stand table;

a yoke means operably mounted to said gear works and adapted for mounting on the throw crank shaft; and a handle means operably connected to said gear works to move said yoke;

mounting said housing on said table; and connecting said yoke means in said housing to said throw crank shaft for rotation therewith.

2. An adaptor for use on a railway switch stand, the switch stand of the type having a reciprocating connecting rod extending therefrom for operating a railway track switch between open and thrown positions, a throw crank operably mounted on a base and connected to the connecting rod to reciprocate the connecting rod, the throw crank including a vertically oriented shaft extending upwardly from the base and rotatable to reciprocate the connecting rod, a table mounted to the upper ends of generally vertical legs projecting upwardly from said base, said table supported above the base, and the throw crank shaft being journaled through an aperture in the table to project upwardly therefrom, said adaptor comprising:

gear works operably mounted within a housing;

said housing having fastening means for removably mounting said housing above said switch stand table;

a yoke means adapted for mounting on said shaft for rotation therewith and operably mounted to said gear works; and handle means operably connected to said gear works so as to move said yoke, said gear works adapted to produce a mechanical advantage.

3. The adaptor of claim 2, wherein said gear works includes a beveled gear mounted on said yoke for rotation therewith, and a pinion gear rotatably mounted in said housing so as to intermesh with said beveled gear, said pinion gear rotatable on its longitudinal axis.

4. The adaptor of claim 3, wherein .said handle means has a rotatable wheel type handle, said handle connected to said pinion gear for rotation therewith, such that rotation of the wheel will rotate the pinion gear, move the bevel gear and thereby rotate said throw crank shaft to move said railway switch.

5. The adaptor of claim 2, further comprising locking means on said handle means for locking said handle means in a position wherein the railway switch is either open or thrown.

6. The adaptor of claim 5, wherein said handle means is a rotatable wheel type handle, rotatably mounted on a forward end of said housing, and wherein said locking means includes: a backing plate mounted on said housing and projecting generally parallel and adjacent to said handle, said backing plate having a slot cut therein along an upper edge thereof;

an operable locking arm pivotally connected to said handle and located to selectively engage the slot in said backing plate when said wheel is rotated to a predetermined position; and said locking arm pivotable between a locked position projecting from said wheel into said backing plate slot, and an unlocked position out of engagement with said backing plate slot.

7. A method for modifying a conventional switch stand, said switch stand of the type having a reciprocating connecting rod extending therefrom for operating a railway track switch to open and thrown positions, a throw crank operably mounted on a base and connected to the connecting rod to reciprocate the connecting rod, said throw crank including a vertically oriented shaft extending upwardly from the base and rotatable to reciprocate the connecting rod, a table mounted on legs and supported above the base, said throw crank being journaled through an aperture in said table and projecting upwardly therefrom, a yoke connected to the throw crank shaft above the table for rotation with said shaft, and a handle connected to said yoke for moving said yoke to rotate said shaft, comprising the steps of:

removing said handle and yoke from said throw crank shaft; providing an adaptor comprising:

gear works operably mounted within a housing;

said housing having means for removably mounting said housing on the switch stand table;

a yoke means operably mounted to said gear works and adapted for mounting on the throw crank shaft; and a handle means operably connected to said gear works to move said yoke;

mounting said housing on said table; and connecting said yoke means in said housing to said throw crank shaft for rotation therewith.

8. The method of claim 7, wherein said conventional switch stand further includes a table having two vertically oriented slots formed in the edge thereof for selectively receiving the conventional switch stand handle, and wherein the step of mounting said housing to said table includes the steps of:

providing bolts projecting downwardly from said housing;

mounting said housing to said table by journaling said bolts through said vertical slots in said table and attaching a clamping plate between said plate bolts below said table; and attaching nuts to said bolts to fasten the clamping plate and housing in position.

9. A method for modifying a conventional switch stand, said switch stand of the type having a reciprocating connecting rod extending therefrom for operating a railway track switch to open and thrown positions, a throw crank operably mounted on a base and connected to the connecting rod to reciprocate the connecting rod, said throw crank including a vertically oriented shaft extending upwardly from the base and rotatable to reciprocate the connecting rod, a table connected to the upper ends of a pair of legs and supported above the base, said throw crank being journaled through an aperture in said table and projecting upwardly therefrom, a yoke connected to the throw crank shaft above the table for rotation with said shaft, and a handle connected to said yoke for moving said yoke to rotate said shaft, comprising the steps of:

removing said handle and yoke from said throw crank shaft;

disconnecting and removing said table from said legs;

providing an adaptor comprising:

gear works operably mounted within a housing;

said housing being mounted on a switch stand table;

a yoke means operably mounted to said gear works and adapted for mounting on the throw crank shaft; and a handle means operably connected to said gear works to move said yoke;

mounting said adaptor table on said legs; and connecting said yoke means in said housing to said throw crank shaft for rotation therewith.

* * * * *